US007810333B2

(12) United States Patent
Kraemer et al.

(10) Patent No.: US 7,810,333 B2
(45) Date of Patent: Oct. 12, 2010

(54) METHOD AND APPARATUS FOR OPERATING A TURBINE ENGINE

(75) Inventors: Gilbert O. Kraemer, Greer, SC (US); Benjamin Lacy, Greer, SC (US); John Joseph Lipinski, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1045 days.

(21) Appl. No.: 11/537,730

(22) Filed: Oct. 2, 2006

(65) Prior Publication Data

US 2008/0078160 A1 Apr. 3, 2008

(51) Int. Cl.
*F02C 1/00* (2006.01)
*F02G 3/00* (2006.01)

(52) U.S. Cl. ..... 60/737

(58) Field of Classification Search ..... 60/776, 60/742, 740, 737, 734, 739, 747
See application file for complete search history.

(56) References Cited

U.S. PATENT DOCUMENTS

| | | | | |
|---|---|---|---|---|
| 4,618,323 | A | 10/1986 | Mansour | |
| 5,437,158 | A | 8/1995 | Fric | |
| 5,479,781 | A | 1/1996 | Fric et al. | |
| 5,494,437 | A | 2/1996 | Kubota et al. | |
| 5,680,766 | A * | 10/1997 | Joshi et al. | 60/746 |
| 5,746,048 | A | 5/1998 | Shah | |
| 6,067,790 | A | 5/2000 | Choi et al. | |
| 6,192,688 | B1 | 2/2001 | Beebe | |
| 6,360,525 | B1 | 3/2002 | Senior et al. | |
| 6,474,071 | B1 | 11/2002 | Durbin et al. | |
| 6,550,696 | B2 | 4/2003 | Mansour et al. | |
| 6,568,190 | B1 * | 5/2003 | Tiemann | 60/804 |
| 6,705,855 | B2 * | 3/2004 | Nagayama et al. | 431/12 |
| 6,908,298 | B1 | 6/2005 | Dykema | |
| 2004/0035114 | A1 * | 2/2004 | Hayashi et al. | 60/737 |

* cited by examiner

*Primary Examiner*—Michael Cuff
*Assistant Examiner*—Andrew Nguyen
(74) *Attorney, Agent, or Firm*—Armstrong Teasdale LLP

(57) ABSTRACT

A method of operating a turbine engine includes providing at least one combustor having a chamber defined therein. The assembly includes at least one combustor wall defining the chamber and a first fluid passage defining a first fluid inlet within the wall. The first fluid passage is coupled in flow communication with the chamber and is configured to inject a first fluid stream. The assembly further includes at least one second fluid passage defining at least one second fluid inlet within the wall. The second fluid inlet is adjacent to the first fluid inlet and is coupled in flow communication with the chamber. The method also includes injecting the first fluid stream and injecting the second fluid stream into the chamber at an oblique angle with respect to the first fluid stream, thereby intersecting and mixing the second fluid stream with the first fluid stream.

35 Claims, 7 Drawing Sheets

METHOD AND APPARATUS FOR OPERATING A TURBINE ENGINE

BACKGROUND OF THE INVENTION

This invention relates generally to rotary machines and more particularly, to methods and apparatus for operating gas turbine engines.

At least some known gas turbine engines combust a fuel and air mixture to release heat energy from the mixture to form a high temperature combustion gas stream that is channeled to a turbine via a hot gas path. The turbine converts thermal energy from the combustion gas stream to mechanical energy that rotates a turbine shaft. The output of the turbine may be used to power a machine, for example, an electric generator or a pump.

At least one by-product of the combustion reaction may be subject to regulatory limitations. For example, within thermally-driven reactions, nitrogen oxide ($NO_x$) may be formed by a reaction between nitrogen and oxygen in the air initiated by the high temperatures within the gas turbine engine. Generally, engine efficiency increases as the combustion gas stream temperature entering a turbine section of the engine increases. However, increasing the combustion gas temperature may facilitate an increased formation of $NO_x$.

Combustion normally occurs at or near an upstream region of a combustor that is normally referred to as the reaction zone or the primary zone. Mixing and combusting of fuel and air may also occur downstream of the reaction zone in a region often referred to as a dilution zone. Inert diluents may be introduced directly into the dilution zone to dilute the fuel and air mixture to facilitate achieving a predetermined mixture and/or temperature of the gas stream entering the turbine section. However, inert diluents are not always available, may adversely affect an engine heat rate, and may increase capital and operating costs. Steam may be introduced as a diluent, however, steam may shorten a life expectancy of the hot gas path components.

To facilitate controlling $NO_x$ emissions during turbine engine operation, at least some known gas turbine engines use combustors that operate with a lean fuel/air ratio and/or wherein the combustors are operated such that fuel is premixed with air prior to being admitted into the combustor's reaction zone. Premixing may facilitate reducing combustion temperatures and subsequently reduce $NO_x$ formation without requiring diluent addition. However, if the fuel used is a process gas or a synthetic gas, or syngas, the process gas and/or syngas selected may include sufficient hydrogen such that an associated high flame speed may facilitate autoignition, flashback, and/or flame holding within a mixing apparatus. Moreover, such high flame speed may not facilitate uniform fuel and air mixing prior to combustion.

BRIEF DESCRIPTION OF THE INVENTION

In one aspect, a method of operating a turbine engine is provided. The method includes providing at least one combustor assembly having a combustion chamber defined therein, wherein the combustion chamber has a centerline extending therethrough. The method also includes injecting at least one first fluid stream into the combustion chamber. The method further includes injecting at least one second fluid stream into the combustion chamber at an oblique angle with respect to the at least one first fluid stream, thereby intersecting and mixing the at least one second fluid stream with the at least one first fluid stream.

In another aspect, a combustor assembly is provided. The assembly includes at least one combustor wall defining a combustion chamber. The assembly also includes at least one first fluid passage defining at least one first fluid inlet within the at least one combustor wall. The at least one first fluid passage is coupled in flow communication with the combustion chamber. The at least one first fluid inlet is configured to inject a first fluid stream into the combustion chamber. The assembly further includes at least one second fluid passage defining at least one second fluid inlet within the at least one combustor wall. The at least one second fluid inlet is adjacent to the at least one first fluid inlet and is coupled in flow communication with the combustion chamber. The second fluid inlet is configured to inject a second fluid stream into the combustion chamber at an oblique angle with respect to the first fluid stream such that the second and first fluid streams intersect at a predetermined angle of incidence.

In a further aspect, a turbine engine is provided. The engine includes at least one first fluid source, at least one second fluid source, and a combustor assembly coupled in flow communication with the at least one first fluid source and the at least one second fluid source. The combustor assembly includes at least one combustor wall, at least one first fluid passage, and at least one second fluid passage. The at least one combustor wall defines a combustion chamber The at least one first fluid passage defines at least one first fluid inlet within the at least one combustor wall and the at least one first fluid passage is coupled in flow communication with the combustion chamber. The at least one first fluid inlet is configured to inject a first fluid stream into the combustion chamber. The at least one second fluid passage defines at least one second fluid inlet within the at least one combustor wall. The at least one second fluid inlet is positioned adjacent to the at least one first fluid inlet. The at least one second fluid inlet is coupled in flow communication with the combustion chamber and is configured to inject a second fluid stream into the combustion chamber at an oblique angle with respect to the first fluid stream such that the second fluid and first fluid streams intersect at a predetermined angle of incidence.

DETAILED DESCRIPTION OF THE INVENTION

Figure 1:
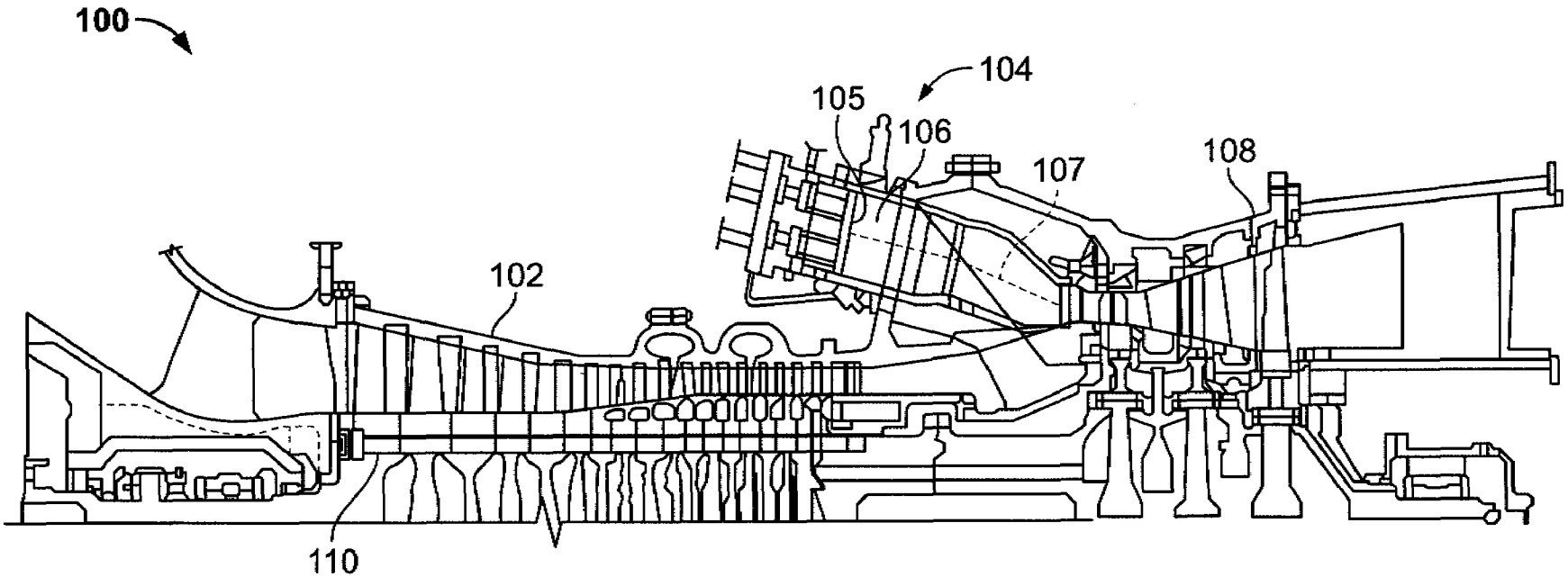
FIG. 1 is a cross-sectional schematic view of an exemplary gas turbine engine.

FIG. 1 is a schematic illustration of an exemplary gas turbine engine 100. Engine 100 includes a compressor 102 and a combustor assembly 104. Combustor assembly 104 includes a combustor assembly wall 105 that at least partially defines a combustion chamber 106. Combustion chamber 106 has a centerline 107 that extends therethrough. In the exemplary embodiment, engine 100 includes a plurality of combustor assemblies 104. Combustor assembly 104, and, more specifically, combustion chamber 106 is coupled downstream from and in flow communication with compressor 102. Engine 100 also includes a turbine 108 and a compressor/turbine shaft 110 (sometimes referred to as a rotor). In the exemplary embodiment, combustion chamber 106 is substantially cylindrical and is coupled in flow communication with turbine 108. Turbine 108 is rotatably coupled to, and drives, shaft 110. Compressor 102 is also rotatably coupled to shaft 110. In one embodiment, engine 100 is a MS7001FB engine, sometimes referred to as a 7FB engine, commercially available from General Electric Company, Greenville, S.C. The present invention is not limited to any one particular and may be implemented in connection with other engines.

In operation, air flows through compressor 102 and a substantial amount of compressed air is supplied to combustor assembly 104. Assembly 104 is also in flow communication with a fuel source (not shown in FIG. 1) and channels fuel and air to combustion chamber 106. In the exemplary embodiment, combustor assembly 104 ignites and combusts fuel, for example, process gas and/or synthetic gas (syngas) within combustion chamber 106 that generates a high temperature combustion gas stream (not shown in FIG. 1) of approximately 871°Celsius (C.) to 1593° C. (1600° Fahrenheit (F.) to 2900° F.). Alternatively, assembly 104 combusts fuels that include, but are not limited to natural gas and/or fuel oil. Combustor assembly 104 channels the combustion gas stream to turbine 108 wherein gas stream thermal energy is converted to mechanical rotational energy.

Figure 2:
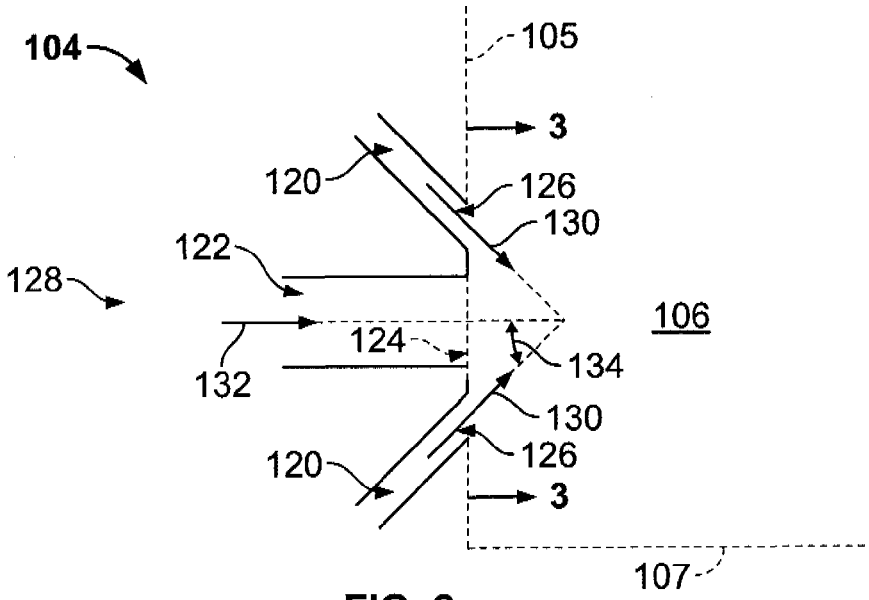
FIG. 2 is a cross-sectional schematic view of a portion of an exemplary combustor assembly that may be used with the gas turbine engine shown in FIG. 1.
Figure 3:
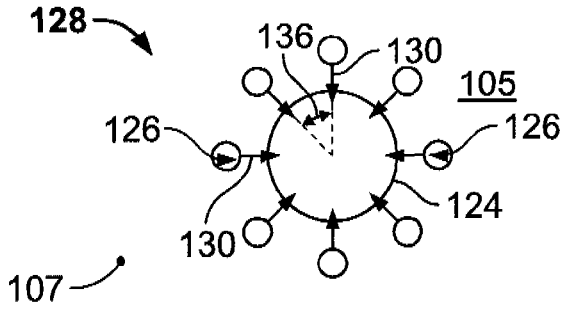
FIG. 3 is a cross-sectional schematic view of the combustor assembly shown in FIG. 2 and taken along line 3-3.

FIG. 2 is a cross-sectional schematic view of combustor assembly 104. FIG. 3 is a cross-sectional schematic view of combustor assembly 104 taken along line 3-3. Specifically, FIG. 3 illustrates an exemplary fuel-air array 128 used with combustor assembly 104. In general, combustor assembly 104 includes at least one first fluid passage that defines a first fluid inlet, wherein both the passage and inlet facilitate forming a first fluid stream. In the exemplary embodiment, combustor assembly 104 includes at least one air passage 122. Moreover, in general, combustor assembly 104 includes at least one second fluid passage that defines a second fluid inlet, wherein both the passage and the inlet facilitate forming a second fluid stream. In the exemplary embodiment, combustor assembly 104 includes a plurality of fuel passages 120. Alternatively, combustor assembly 104 includes a plurality of first fluid, or air, passages adjacent to at least one second fluid, or fuel, passage (neither shown) configured and positioned within assembly 104 to facilitate operation of engine 100 as described herein.

Air passage 122 is coupled in flow communication with at least one first fluid source that, in the exemplary embodiment, is compressor 102 (shown in FIG. 1). Alternatively, the first fluid source may be any source that facilitates operation of engine 100 as described herein. Fuel passages 120 are coupled in flow communication to at least one second fluid source that, in the exemplary embodiment, is a fuel source (not shown in FIG. 2 or 3).

In the exemplary embodiment, air passage 122 defines an air inlet 124 within a portion of combustor wall 105 that facilitates channeling an air stream 132 (illustrated with the associated arrow). Similarly, in the exemplary embodiment, fuel passages 120 define a plurality of fuel inlets 126 within a portion of a combustor wall 105. Fuel passages 120 facilitate channeling a plurality of fuel streams 130 (illustrated with a plurality of associated arrows). Alternatively, first fluid passages (or, air passage 122) and/or second fluid passages (or, fuel passages 120) may be configured to channel other fluids that include, but are not limited to, premixed fuel and air, inert diluents and exhaust gases.

When assembled, fuel inlets 126, air inlet 124 and combustor wall 105 define a fuel-air array 128. In the exemplary embodiment, array 128 provides a lean direct injection (LDI) method of combustion within combustor assembly 104 as described further below. FIGS. 2 and 3 illustrate air passage 122 as substantially perpendicular to wall 105 and substantially parallel to combustion chamber centerline 107. As explained further below, fuel-air array 128 is configured with passage 122 and associated air inlet 124 having any angle of entrance into combustion chamber 106 with respect to wall 105 and centerline 107. Specifically, passage 122 may be configured with an upward or downward orientation and/or a leftward or rightward orientation, and any combination thereof, with respect to centerline 107. Therefore, in the exemplary embodiment, passage 122 is configured with any orientation with respect to wall 105 and centerline 107 that facilitates impingement of fuel stream 130 and air stream 132 as described herein.

A method of operating turbine engine 100 includes providing at least one combustor assembly 104 having combustion chamber 106 defined therein, wherein combustion chamber 106 has centerline 107 extending therethrough. The method also includes injecting at least one first fluid stream into combustion chamber 106, wherein, in the exemplary embodiment, the method includes injecting air stream 132 into combustion chamber 106. The method further includes injecting at least one second fluid stream into the combustion chamber, wherein, in the exemplary embodiment, the method includes injecting fuel stream 130 into combustion chamber 106 at oblique angle 134 with respect to air stream 132, thereby intersecting and mixing fuel stream 130 with air stream 132. Alternatively, first fluid passages (or, air passage 122) and/or second fluid passages (or, fuel passages 120) channel other fluid streams (not shown) that include, but are not limited to, premixed fuel and air, inert diluents and exhaust gases.

In operation, fuel passages 120 channel plurality of fuel streams 130 and air passage 122 channels air stream 132 through fuel-air array 128 into combustion chamber 106. Air stream 132 may flow substantially uniformly or may flow non-uniformly, for example, stream 132 may be swirled prior to entry into fuel-air array 128. In the illustrated embodiment, air stream 132 is injected into combustion chamber 106 substantially parallel to combustion chamber centerline 107 and substantially perpendicular to wall 105. To enhance mixing, fuel streams 130 are each injected into combustion chamber 106 at predetermined oblique radial angles of incidence 134 with respect to air stream 132 and at predetermined oblique circumferential angles of incidence 136 with respect to air stream 132. More specifically, in the exemplary embodiment, fuel streams 130 are each injected at a radial angle of incidence 134 between 0° and 90°, and at a circumferential angle of incidence 136 between 0° to 360°. The number of fuel inlets 126, the values of radial angles 134 and the values of circumferential angles 136 are variably selected based on a variety of operating parameters that facilitate rapid and thorough mixing of the fuel and air subsequent to fuel streams 130 and air stream 132 impingement.

In the exemplary embodiment, fuel streams 130 include process gas and/or syngas as the primary fuels. Alternatively, any fuel that facilitates operation of combustor assembly 104 as described herein may be used. Syngas is synthesized using methods known in the art and typically has a varying chemical composition that at least partially depends upon the method of synthesis. Process gas is typically a byproduct of chemical processes that include, but are not limited to, petroleum refining. Syngas and process gas typically include vaporized hydrocarbons that may include, but are not limited to, liquid fuels, or distillates. Syngas and process gas may also include less reactive combustible constituents, inerts and impurities as compared to the associated primary combustible constituents known in the art.

In the exemplary embodiment, array 128 provides a lean direct injection (LDI) method of combustion within combustor assembly 104. An LDI method of combustion is typically defined as an injection scheme that injects fuel and air into a combustion chamber of a combustor with no premixing of the air and fuel prior to injection. This method is in contrast to a lean premixed injection method of combustion that is typically defined by premixing at least a portion of each of fuel and air within a premixer portion of a combustor, thereby forming a fuel-air mixture that is subsequently injected into a combustion chamber. The lean premixed combustion method of combustion is typically characterized by lower flame temperatures than that typically characterized by traditional non-premixed, or diffusion, methods of combustion. The lower combustion temperatures associated with the lean premixed combustion method facilitates a reduction in the rate and magnitude of formation of $NO_x$, however, the fuel-air mixture is generally flammable, and a potential for undesirable flashback of ignition and combustion into the premixer section of the combustor is facilitated.

Some fuel and air mixtures generally facilitate rapid reaction rates and subsequently facilitate a relatively high flame speed as compared to other fuels. Flame speed may be defined as a rate of ignition, spread and propagation of combustion within a fuel-air mixture. A flame speed that is substantially equal to a fuel flow speed facilitates a substantially stable and stationary flame. Higher flame speeds may facilitate autoignition, flashback, and/or flame holding within areas of a combustor not designed to accomodate an associated nearby heat release. Flame holding is facilitated when a residence time of a mixture of fuel and air in a pre-defined volume is greater than the fuel and air mixture's reaction time within the same volume, and a resultant flame as a result of combustion of fuel and air is realized. Specifically, when a flame speed is substantially similar to a fuel-air mixture flow speed, a resultant flame may be characterized as stable.

Thermal $NO_x$ is typically defined as $NO_x$ formed during combustion of fuel and air through high temperature oxidation of nitrogen found in air. The formation rate is primarly a function of a temperature associated with the local combustion of fuel and air within a pre-defined region and the residence time of nitrogen at that temperature, wherein the residence time is substantially similar to the fuel and air residence time as described above. Therefore, at least two factors that affect $NO_x$ production are combustion temperatures and the residence time of nitrogen at those temperatures. Residence time is further defined as the time period wherein a portion of fuel and a portion of air are mixed together to complete ignition and combustion such that only post-combustion products remain including, but not limited to, heat, water, nitrogen, and carbon dioxide. In general, as the temperature of combustion and/or the residence time increase, a rate of $NO_x$ generation increases as well. Optimizing residence times and temperatures facilitates complete combustion and also facilitates the mitigation of $NO_x$ generation. The high reaction rate of certain fuels and air as described above facilitates mitigating fuel and air mixing, thereby facilitating $NO_x$ production. This is due to the increased localized temperatures associated with the rapid ignition of the fuel as well as the increased residence time needed to combine the fuel and air to facilitate substantially complete combustion. In general, levelizing a pre-determined reaction rate of fuel and air molecules in a pre-determined volume through aggressive fuel and air mixing facilitates levelizing localized exothermic energy release and, therefore, localized temperatures within the volume.

When conditions are such that a fuel-air mixture may ignite, complete ignition that generates a flame does not occur immediately, but rather ignition occurs with a delay, typically referred to as an ignition delay, or an induction period, that depends on factors that include, but are not limited to, the particular type of fuel being ignited, a fuel-air mixture temperature, and the relative concentrations of fuel molecules and air molecules. As the induction period increases, the time available for air and fuel mixing increases. Some fuels typically have a relatively short induction period. In contrast to residence time, a shortened induction period facilitates combustion on a microscopic scale while facilitating a need for a longer residence time to facilitate thorough fuel and air mixing and substantially complete combustion on a macroscopic scale.

Flame stability, completeness of combustion, and $NO_x$ production may also be affected by turbulence and/or swirling of fuel and air prior to combustion. A relative magnitude of swirling is often represented with a swirl number. A swirl number is typically defined as a ratio of a tangential momentum of fuel and air molecules as compared to, or divided by, an axial momentum of the same fuel and air molecules. Swirling and turbulence are contrasted in that a swirl number is a characteristic reflecting the magnitude of turbulence. The magnitude of turbulence may also be reflected by characteristics that include, but are not limited to, irregular (or random) flows and diffusive flows. Increasing the turbulence and/or swirl may facilitate decreasing the residence time and the peak and local temperatures of combustion of fuel and air, thereby facilitating a decrease in $NO_x$ production.

In some embodiments, fluids that include, but are not limited to, premixed fuel and air, inert diluents and exhaust gases, may also be injected to facilitate methods of establishing flame stability, completeness of combustion, and a decrease in $NO_x$ production as described herein. Hereon, wherein only fuel and air are discussed, and unless otherwise noted, the discussion should be assumed to include such fluids for injection into combustion chamber 106 in conjunction with fuel and air.

Impinging multiple stream flows onto each other, for example, fuel and air streams 130 and 132, respectively, as well as inert diluents and/or at least partially premixed fuel and air (neither shown) within fuel-air array 128, with predetermined angles of incidence, flow velocities, and mass flow rates, forms a predetermined vortex (not shown) that includes at least one localized flow field (not shown) that is defined within a pre-determined volume and with a pre-determined set of characteristics that includes, but is not limited to, a pre-determined turbulence, residence time and temperature. A combustor assembly, for example, assembly 104, with multiple fuel-air arrays 128 will facilitate forming the vortex that includes multiple localized flow fields (not shown). Such multiple localized flow fields may interact with each other to form the vortex (not shown) that includes a bulk flow field (not shown) as discussed further below.

Fuel-air array 128 facilitates rapid mixing of fuel and air within a pre-determined localized flow field (not shown) subsequent to admission into combustion chamber 106. Within array 128, the number of fuel inlets 126, the values of the injection angles of air stream 132 with respect to centerline 107, the values of radial angles 134 and the values of circumferential angles 136, and the size and scale of inlets 124 and 126 are variably selected to form a pre-determined flow field that facilitates rapid and thorough mixing of fuel and air. Specifically, fuel is injected into combustion chamber 106 via inlets 126 with a predetermined velocity that is typically faster than the injection velocity of air injected into chamber 106 via inlet 124, throughout at least a portion of engine 100 (shown in FIG. 1) operational ranges. The higher velocity of fuel stream 130 facilitates rapid and thorough mixing of fuel stream 130 and air stream 132 within the localized flow field combustion chamber 106 upon impingement of streams 130 and 132. More rapid and thorough mixing of streams 130 and 132 facilitates decreasing the fuel-air mixture residence time such that the predetermined residence time within the localized flow field approaches the thermal $NO_x$ induction period, Moreover, more rapid and thorough mixing prior to subsequent combustion facilitates reducing combustion temperature within the localized flow field by levelizing a localized rate of heat release as described above. Both of these effects of rapid mixing facilitate reducing $NO_x$ production while facilitating increasing a heat release rate per unit volume of combustor assembly 104.

LDI methods of combustion as facilitated by fuel-air array 128 also facilitate reducing potentials for autoignition, flashback, and flame holding (in other than pre-determined regions of combustion chamber 104) with respect to lean premixed combustion methods. For example, lack of premixing fuel and air upstream of inlets 124 and 126 reduces a potential for autoignition and flashback within array 128 to substantially zero. Therefore, LDI combustion methods provide some of the benefits of diffusion and lean premixed combustion methods without some of the drawbacks.

Figure 4:
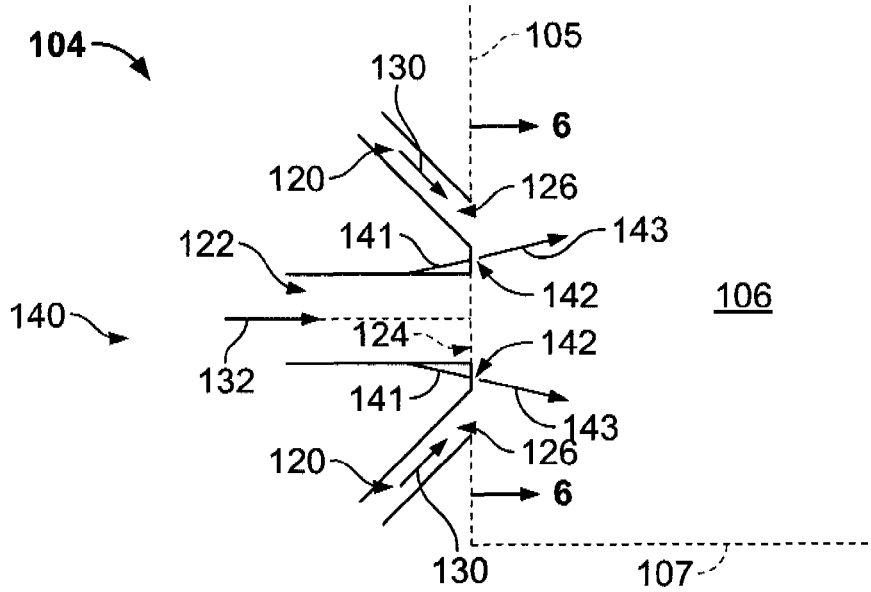
FIG. 4 is a cross-sectional schematic view of an alternative fuel-air array that may be used with the combustor assembly shown in FIG. 2.

FIG. 4 is a cross-sectional schematic view of an alternative fuel-air array 140 that may be used with combustor assembly 104. Array 140 is substantially similar to array 128 with the exception that array 140 includes at least one purge and cooling air passage 141 coupled in flow communication with air passage 122 and combustion chamber 106. Each of passages 141 form a inlet 142 within wall 105 that facilitates channeling a purge and cooling air stream 143 into chamber 106. Air passages 141 may be orientated with any angle with respect to centerline 107 and wall 105 to facilitate operation of combustor assembly 104 as described herein, including for example, not parallel to air passage 122 and at different angles relative to each other. In operation, air passages 141 facilitate mitigating flame holding near wall 105 between air inlet 124 and fuel inlets 126 by injecting at least a portion of air stream 132 into the associated regions within chamber 106. Such method facilitates purging fuel away from wall 105. Moreover, such method facilitates cooling of localized regions of wall 105. Alternatively, passages 141 channel fuel-air mixtures and/or inert diluents to facilitate mitigating flame holding and facilitate cooling as described above.

Figure 5:
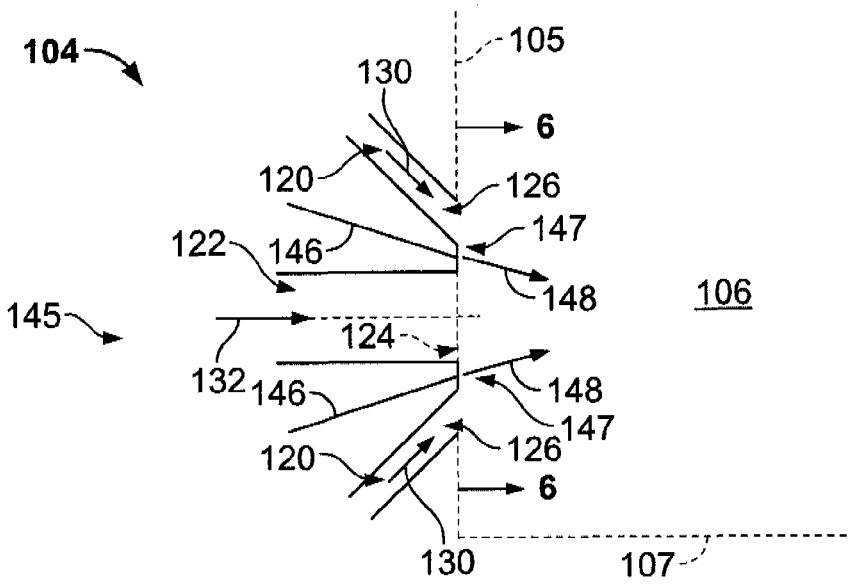
FIG. 5 is a cross-sectional schematic view of another alternative fuel-air array that may be used with the combustor assembly shown in FIG. 2.

FIG. 5 is a cross-sectional schematic view of another alternative fuel-air array 145 that may be used with combustor assembly 104. Array 145 is substantially similar to array 128 with the exception that array 145 includes at least one purge and cooling fluid passage 146 coupled in flow communication with at least one fluid source (not shown in FIG. 5) and combustion chamber 106. In an alternative embodiment, the fluids that may be used include, but are not limited to, air, premixed fuel and air, and/or inert diluents. Each of passages 146 form an inlet 147 within wall 105 that facilitates channeling a purge and cooling fluid stream 148 into chamber 106. Air passages 146 may be orientated with any angle with respect to centerline 107 and wall 105 to facilitate operation of combustor assembly 104 as described herein, including for example, not parallel to air passage 122 and at different angles relative to each other. In operation, air passages 146 facilitate mitigating flame holding near wall 105 between air inlet 124 and fuel inlets 126 by injecting fluid streams 148 into the associated regions within chamber 106. Such method facilitates purging fuel away from wall 105. Moreover, such method facilitates cooling of localized regions of wall 105.

Figure 6:
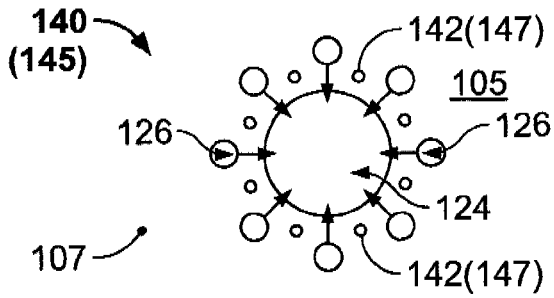
FIG. 6 is a cross-sectional schematic view of the alternative fuel air arrays shown in FIGS. 4 and 5 and taken along line 6-6.

FIG. 6 is a cross-sectional schematic view of alternative fuel air arrays 140 (shown in FIG. 4) and 145 (shown in FIG. 5) taken along line 6-6. Purge and cooling air inlets 142 are positioned radially between fuel inlets 126 and air inlet 124 within array 140. Purge and cooling fluid inlets 147 are positioned in a similar manner within array 145. Inlets 142 and inlets 147 may be positioned circumferentially about inlet 124 that facilitates operation of combustor assembly 104 as described herein. Further, alternatively, any combination of air inlets 142 and fluid inlets 147 may be used that facilitates operation of combustor assembly 104 as described herein. Also, alternatively, fuel-air arrays 140 and 145 include a plurality of first fluid, or air, passages circumferentially adjacent to at least one second fluid, or fuel, passage (neither shown) configured and positioned within fuel-air arrays 140 and 145 to facilitate operation of engine 100 as described herein are used.

Figure 7:
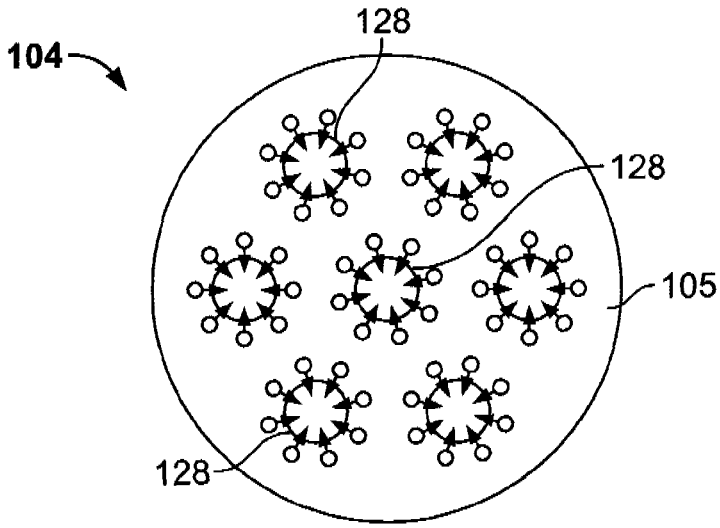
FIG. 7 is a schematic end view of a plurality of exemplary fuel air arrays that may be used with the combustor assembly shown in FIG. 2.

FIG. 7 is a schematic end view of a plurality of exemplary fuel air arrays 128 that may be used with combustor assembly 104. In the exemplary embodiment, wall 105 includes a plurality of fuel-air arrays 128 that are positioned at predetermined distances apart from each other. An increased number of arrays 128 positioned within a specific region of wall 105, i.e., a greater density of arrays 128 facilitates a greater ratio of surface area of wall 105 associated with arrays 128 to volumetric fluid flow through arrays 128 into combustion chamber 106 (shown in FIG. 2). Increasing this "surface-to-volume" ratio subsequently facilitates an increase of the thoroughness and rapidity of fuel and air mixing within combustion chamber 106, thereby facilitating a decrease in residence time and a decrease in combustion temperature such that a decrease in $NO_x$ production is subsequently facilitated. Alternatively, fuel-air arrays 140 and/or 145 may be positioned in place of, or, adjacent to, fuel-air arrays 128. Further, alternatively, alternate embodiments (not shown) of fuel-air arrays 128, 140 and/or 145 that include a plurality of first fluid, or air, passages circumferentially adjacent to at least one second fluid, or fuel, passage (neither shown) configured and positioned within fuel-air arrays 128, 140 and/or 145 to facilitate operation of engine 100 as described herein are used.

Figure 8:
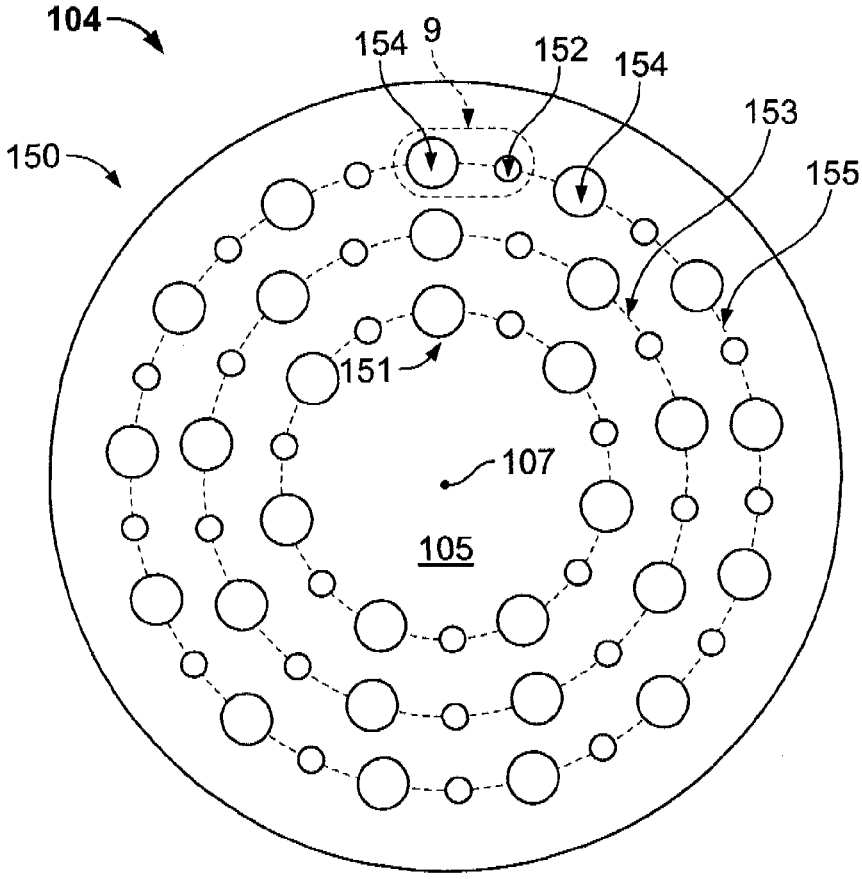
FIG. 8 is a schematic end view of an alternative fuel-air array that may be used with the combustor assembly shown in FIG. 2.

FIG. 8 is a schematic end view of an alternative fuel-air array 150 that may be used with combustor assembly 104. Array 150 includes a plurality of fuel inlets 152 and air inlets 154 defined within wall 105. Inlets 152 and 154 are substantially similar to inlets 126 and 124, respectively (shown in FIGS. 2 and 3). Within wall 105, a plurality of annular inner, middle, and outer concentric rings 151, 153 and 155, respectively, of fuel inlets 152 and air inlets 154 are defined. Each of inlets 152 and 154 are configured with predetermined radial and circumferential angles of incidence (not shown in FIG. 8) to form a plurality of fuel and air impingements that facilitate air and fuel mixing and vortex formation as described above. For example, each of inlets 152 is configured to facilitate fuel impingement with air associated with circumferentially adjacent air inlets 154 to form a vortex that includes a plurality of pre-determined localized flow fields. Such local flow fields facilitate formation of localized combustion with local flames. Such fuel and air mixing and local flame formation facilitates combining local flames to further facilitate forming pre-determined bulk flow fields and bulk flames as described further below.

One embodiment of alternative fuel-air array 150 includes configuring rings 151, 153 and 155 to form substantially concentric, counter-rotating, or counter-swirling, fuel-air mixing/combustion flow fields (not shown) that subsequently form a predetermined bulk flow field (not shown). For example, rings 151 and 155 may be configured to form clockwise rotating flow fields while ring 153 is configured to form a counter-clockwise flow field. Each of the plurality of radially adjacent concentric rings of swirling mixtures that defines the associated flow fields may have associated fluid currents that flow in substantially opposite circumferential directions. The points of intersection of the opposing fluid currents are typically characterized by swirls flowing in the same direction within localized flow fields. The resultant bulk flow field includes interactions of adjacent counter-swirling flow fields that facilitate forming a pre-determined swirl number and turbulence within the bulk flow field, thereby facilitating formation of a substantially swirl-less bulk flow field with good flame holding characteristics.

Moreover, the regions of the bulk flow field wherein the fuel and air streams (not shown in FIG. 8) locally intersect facilitate flame stabilization. Furthermore, the resultant bulk flow field includes interactions of adjacent co-swirling flow fields that facilitate swirl and turbulence within the bulk flow field that further facilitates formation of the predetermined vortex. Such vortex formation also facilitates vortex breakdown wherein a recirculation zone (not shown) between the bulk flow field and wall 105 forms and the fuel-air mixtures exit the bulk flow field into the recirculation zone. The fuel-air mixtures are then re-injected back into the bulk flow field., thereby facilitating increasing bulk flow field turbulence, decreasing fuel and air residence time, combustion temperatures within the bulk flow field, and subsequently, $NO_x$ formation. Such vortex breakdown also facilitates flame stabilization.

Another embodiment of alternative fuel-air array 150 includes configuring rings 151, 153 and 155 to form a vortex that includes substantially annular, co-rotating fuel-air mixing/combustion flow fields (not shown) that subsequently form a pre-determined bulk flow field (not shown). For example, rings 151, 153 and 155 may be configured to form clockwise co-rotating, or co-swirling, flow fields. Each of the plurality of radially adjacent concentric rings of swirling mixtures that defines the associated flow fields may have associated fluid currents that flow in substantially similar circumferential directions. The resultant bulk flow field includes interactions of adjacent co-swirling flow fields that oppose each other such that they facilitate swirl and turbulence within the bulk flow field that further facilitates formation of the predetermined vortex with mixing fuel and air characteristics typically superior to those of counter-swirling embodiments as described above.

Another embodiment of alternative fuel-air array 150 includes configuring each of fuel inlets 152 and air inlets 154 such that any combination of inlets 152 and 154 in any of rings 151, 153 and 155 may be in service throughout a range of operation of engine 100 (shown in FIG. 1). For example, array 150 is configured such that a pre-determined number of, and arrangement of, fuel inlets 152 are in service for a particular range of power generation of engine 100. The predetermined configuration of active fuel inlets 152 facilitates sufficient heat release to support power generation demands while forming a vortex that facilitates fuel and air mixing to mitigate $NO_x$ formation. Such configurations may include, but not be limited to, configuring 153 to form localized and swirling ring flow fields that interact with localized and swirling ring flow fields formed by ring 151 differently than those formed by ring 155.

Figure 9:
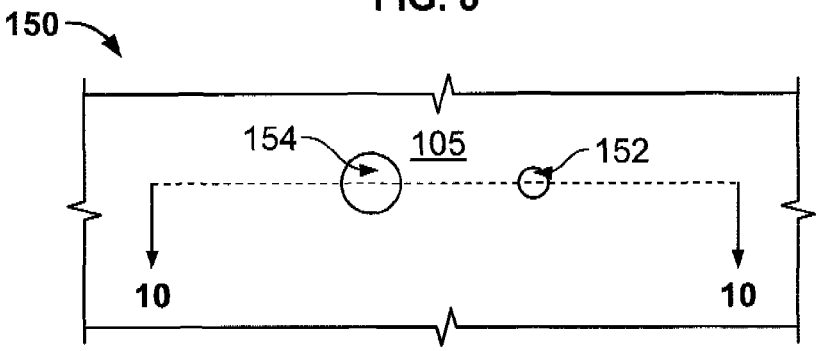
FIG. 9 is a cross-sectional schematic view of a portion of the fuel-air array shown in FIG. 8 and taken along ellipse 9-9.
Figure 10:
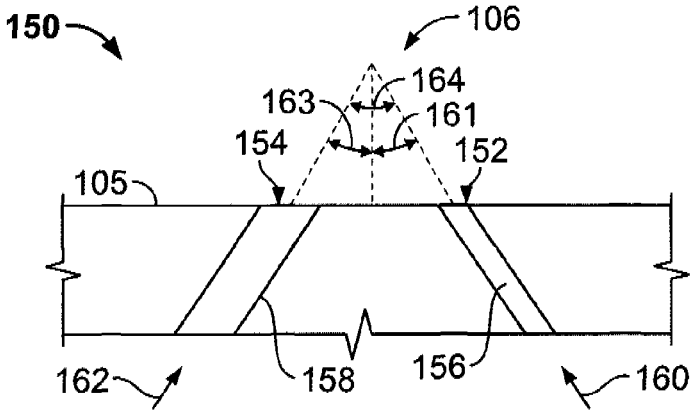
FIG. 10 is a cross-sectional overhead schematic view of the portion of the fuel-air array shown in FIG. 9 and taken along line 10-10.

FIG. 9 is a cross-sectional schematic view of a portion of fuel-air array 150 shown in FIG. 8 and taken along ellipse 9-9. FIG. 10 is a cross-sectional overhead schematic view of the portion of fuel-air array 150 shown in FIG. 9 and taken along line 10-10. In this configuration, one of each of a fuel inlet 152, air inlet 154, fuel passage 156, and air passage 158 are defined within combustor assembly wall 105. A relative configuration of inlets 152 and 154 are also illustrated below array 150. Passages 156 and 158 facilitate channeling a fuel stream 160 and an air stream 162, respectively, into combustion chamber 106 via inlets 152 and 154. Fuel stream 160 is injected into chamber 106 with a predetermined angle 161 that is oblique to combustion chamber centerline 107 (shown in FIG. 8). Air stream 162 is injected into chamber 106 with a predetermined angle 163 that is oblique to combustion chamber centerline 107. Angles 161 and 163 define a predetermined angle of incidence 164 of streams 160 and 162. Predetermined angle of incidence 164 of streams 160 and 162 facilitates thorough and rapid mixing of fuel stream 160 and air stream 162.

Figure 11:
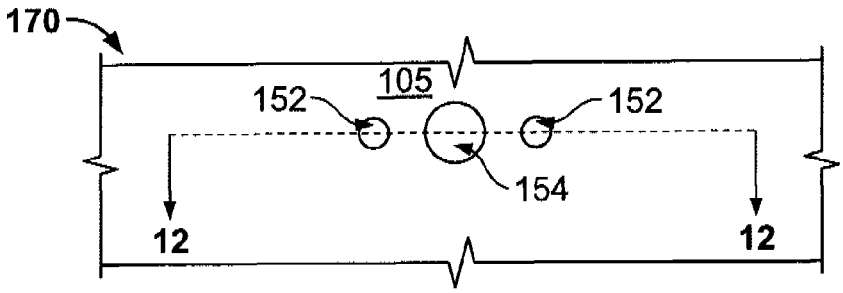
FIG. 11 is a cross-sectional schematic view of a portion of an alternative fuel-air array that may be used with the combustor assembly shown in FIG. 2.
Figure 12:
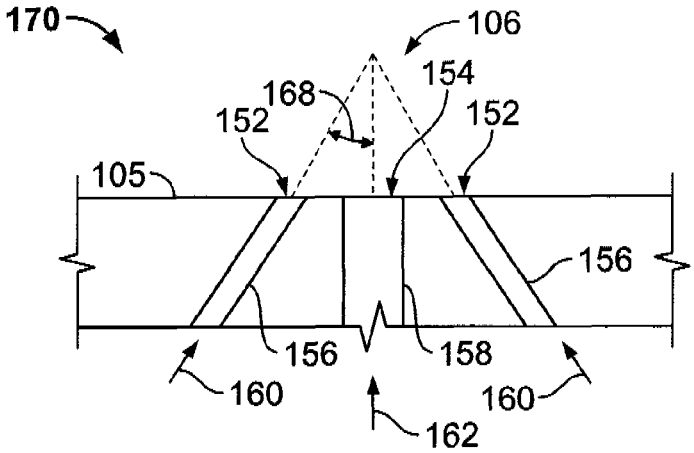
FIG. 12 is a cross-sectional overhead schematic view of the portion of the alternative fuel-air array shown in FIG. 11 taken along line 12-12.

FIG. 11 is a cross-sectional schematic view of a portion of an alternative fuel-air array 170 that may be used with combustor assembly 104 (shown in FIG. 2). FIG. 12 is a cross-sectional overhead schematic view of the portion of alternative fuel-air array 170 shown in FIG. 11 taken along line 12-12. In this configuration, a pair of fuel inlets 152, one air inlet 154, a pair of fuel passages 156 and one air passage 158 are defined within combustor assembly wall 105. Inlets 152 and 154 are also illustrated below array 150 for perspective. Passages 156 and 158 facilitate injecting fuel stream 160 and air stream 162 into combustion chamber 106 via inlets 152 and 154, respectively. Inlet 154 is configured to inject air stream 162 into combustion chamber 106 substantially parallel to combustion chamber centerline 107 (shown in FIG. 8). Inlets 152 are configured to inject streams 160 into chamber 106 at a predetermined oblique radial angle of incidence 168 that facilitates thorough and rapid fuel streams 160 and air stream 162 mixing. Streams 160 may also be oriented with a predetermined oblique circumferential angle of incidence 136 (shown in FIG. 3). Alternatively, one fuel inlet 152, a pair of air inlets 154, one fuel passage 156 and a pair of air passages 158 may be oriented within combustor assembly wall 105 with air passages 158 to ensure streams 162 are injected with predetermined oblique radial and circumferential angles of incidence into stream 160 to facilitate thorough and rapid fuel stream 160 and air streams 162. Also, alternatively, fuel-air array 170 has any number of air inlets 154 and air passages 158 per a single fuel inlet 152 and fuel passage 156 in any configuration that facilitates operation of fuel-air array 170 as described herein.

Figure 13:
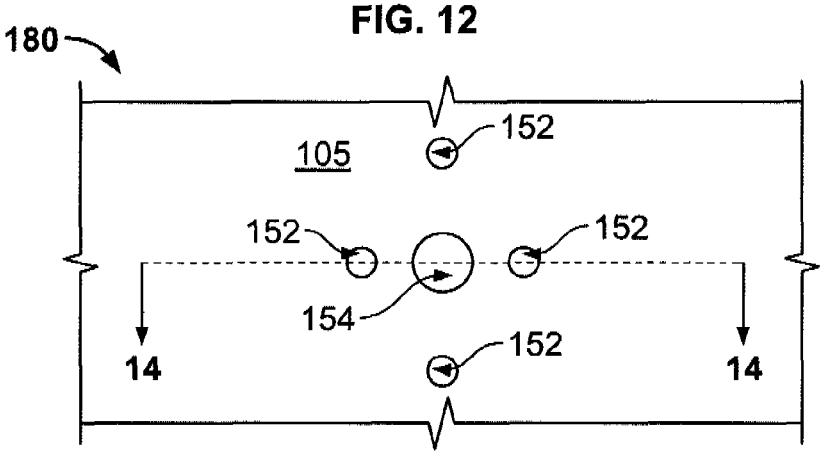
FIG. 13 is a cross-sectional schematic view of a portion of an alternative fuel-air array that may be used with the combustor assembly shown in FIG. 2.
Figure 14:
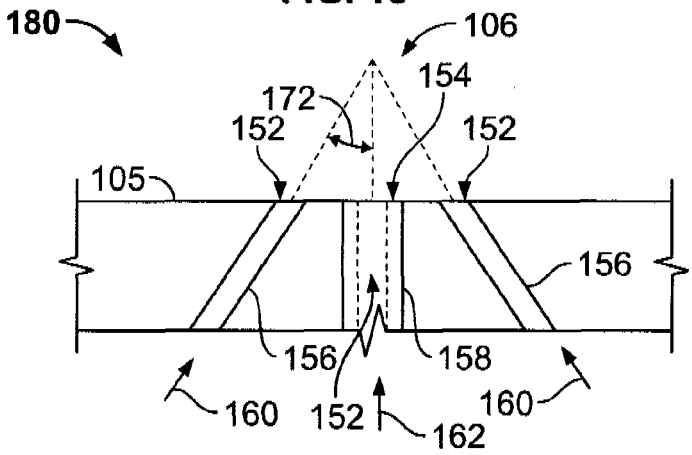
FIG. 14 is a cross-sectional schematic overhead view of the portion of the alternative fuel-air array shown in FIG. 13 taken along line 14-14.

FIG. 13 is a cross-sectional schematic view of a portion of an alternative fuel-air array 180 that may be used with combustor assembly 104 (shown in FIG. 2). FIG. 14 is a cross-sectional schematic overhead view of the portion of alternative fuel-air array 180 shown in FIG. 13 taken along line 14-14. In this configuration, four fuel inlets 152, one air inlet 154, four fuel passages 156 and one air passage 158 are defined within combustor assembly wall 105. A relative configuration of inlets 152 and 154 are also illustrated below array 180 for perspective. Passages 156 and 158 facilitate channeling a fuel stream 160 and an air stream 162, respectively into combustion chamber 106 via inlets 152 and 154, respectively. Inlet 154 is configured to inject air stream 162 into combustion chamber 106 substantially parallel to combustion chamber centerline 107 (shown in FIG. 8). Each inlet 152 is oriented circumferentially about inlet 154 to ensure predetermined oblique radial and circumferential angles of incidence of streams 160 (radial angle 172 is illustrated for perspective) that facilitates thorough and rapid fuel streams 160 and air stream 162. Also, alternatively, one fuel inlet 152, four air inlets 154, one fuel passage 156 and four air passages 158 may be oriented within combustor assembly wall 105 with air passages 158 configured to ensure streams 162 are injected into stream 160 to facilitate thorough and rapid fuel stream 160 and air streams 162 mixing.

Any of arrays 128 (shown in FIGS. 2 and 3), 140 (shown in FIGS. 4 and 6), 145 (shown in FIGS. 5 and 6), 150 (shown in FIGS. 8, 9 and 10), 170 (shown in FIGS. 11 and 12) and 180 (shown in FIGS. 13 and 14) may also facilitate channeling and injection of any combination of premixed fuel, air, and/or inert diluents via any passage that facilitates combustion while reducing $NO_x$ as described herein. Furthermore, any of arrays 128, 140, 145, 150, 170, and 180 may facilitate mitigating flame holding near wall 105 by positioning small air or inert fluid inlets (similar to those illustrated in FIGS. 4, 5 and 6 and not shown in FIGS. 8 through 14) to inject the associated fluid and purge the associated regions of fuel and to also facilitate cooling of at least a portion of wall 105.

Typically, combustion of certain fuels within dry low $NO_x$, typically referred to as DLN, gas turbine engines may be difficult because of the properties associated with the combustible constituents, for example, hydrogen, within the fuels, Any of arrays 128, 140, 145, 150, 170, and 180 may be inserted into substantially any gas turbine engine to facilitate combustion and reducing $NO_x$ through direct injection of fuel, air and/or diluent streams to supplement injection of premixed fuel, air and/or diluents.

Moreover, arrays 128, 140, 145, 150, 170, and 180 facilitate flexible positioning and orienting such arrays 128, 140, 145, 150, 170, and 180 in a wide variety of geometries that facilitate operation of engine 100 over a wide variety of operational power generation ranges using a wide variety of filets and diluents as is discussed further below. Furthermore, increasing a density of fuel-air arrays 128, 140, 145, 150, 170, and 180 within engine 100 facilitates increasing a heat release rate per unit volume of engine 100, thereby facilitating a reduction in the size and cost of engine 100 for a pre-determined operational power generation range.

Figure 15:
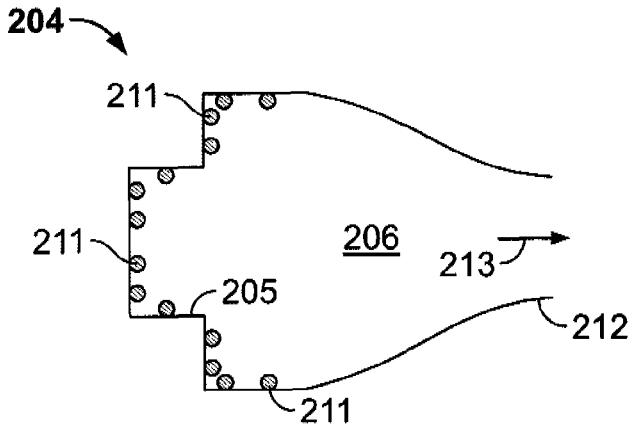
FIG. 15 is a cross-sectional schematic view of an alternative combustor assembly that may be used with the gas turbine engine shown in FIG. 1.

FIG. 15 is a cross-sectional schematic view of an alternative combustor assembly 204 that may be used with engine 100 (shown in FIG. 1). Assembly 204 includes a wall 205 that at least partially forms a combustion chamber 206. Assembly 204 also includes a plurality of LDI fuel-air arrays 211 that are substantially similar to arrays 128 (shown in FIGS. 2 and 3), 140 (shown in FIGS. 4 and 6), 145 (shown in FIGS. 5 and 6), 150 (shown in FIGS. 8, 9 and 10), 170 (shown in FIGS. 11 and 12) and/or 180 (shown in FIGS. 13 and 14). Assembly 204 is configured such that any number of arrays 211 are positioned and oriented in any configuration that facilitates forming a plurality of localized and bulk flow fields (neither shown) that further facilitate heat release rates and $NO_x$ formation rates during substantially the full range of operation of engine 100 as described herein. Assembly 204 further includes a transition piece 212 that facilitates channeling a combustion gas stream 213 towards turbine 108 (shown in FIG. 1). In this alternative embodiment, transition piece 212 may extend from combustion chamber 206 to turbine 108 with a shorter length than is often used in the art. Moreover, in this alternative embodiment, transition piece 212 and wall 205 may be manufactured as an integrated piece.

Figure 16:
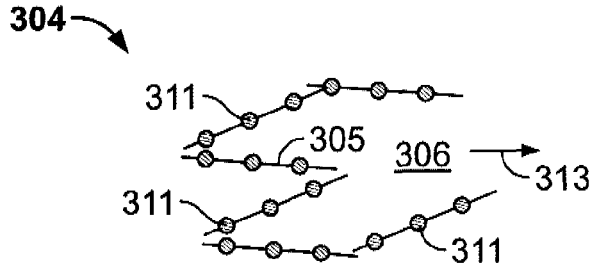
FIG. 16 is a cross-sectional schematic view of an alternative combustor assembly that may be used with the gas turbine engine shown in FIG. 1.

FIG. 16 is a cross-sectional schematic view of an alternative combustor assembly 304 that may be used with engine 100 (shown in FIG. 1). Assembly 304 includes a wall 305 that at least partially forms a combustion chamber 306. Assembly 304 also includes a plurality of LDI fuel-air arrays 311 that are substantially similar to arrays 128 (shown in FIGS. 2 and 3), 140 (shown in FIGS. 4 and 6), 145 (shown in FIGS. 5 and 6), 150 (shown in FIGS. 8, 9 and 10), 170 (shown in FIGS. 11 and 12) and/or 180 (shown in FIGS. 13 and 14). Assembly 304 is configured such that any number of arrays 311 are positioned and oriented in any configuration that facilitates forming a plurality of localized and bulk flow fields (neither shown) that further facilitate heat release rates and NO, formation rates during substantially the full range of operation of engine 100 as described herein. Assembly 304 is directly coupled in flow communication with turbine 108 (shown in FIG. 1) and facilitates channeling a combustion gas stream 313 towards turbine 108 such that such that a transition piece is not used. Arrays 311 are positioned along wall 305 to facilitate cooling of assembly 304.

Figure 17:
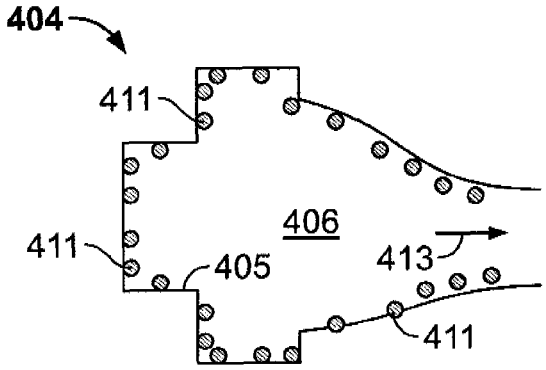
FIG. 17 is a cross-sectional schematic view of an alternative combustor assembly that may be used with the gas turbine engine shown in FIG. 1.

FIG. 17 is a cross-sectional schematic view of an alternative combustor assembly 404 that may be used with engine 100 (shown in FIG. 1). Assembly 404 includes a wall 405 that at least partially forms a combustion chamber 406. Assembly 404 also includes a plurality of LDI fuel-air arrays 411 that are substantially similar to arrays 128 (shown in FIGS. 2 and 3), 140 (shown in FIGS. 4 and 6), 145 (shown in FIGS. 5 and 6), 150 (shown in FIGS. 8, 9 and 10), 170 (shown in FIGS. 11 and 12) and/or 180 (shown in FIGS. 13 and 14). Assembly 404 is configured such that any number of arrays 411 are positioned and oriented in any configuration that facilitates forming a plurality of localized and bulk flow fields (neither shown) that further facilitate heat release rates and $NO_x$ formation rates during substantially the full range of operation of engine 100 as described herein. Assembly 404 is directly coupled in flow communication with turbine 108 (shown in FIG. 1) and facilitates channeling a combustion gas stream 413 towards turbine 108 such that such that a transition piece is not used. Arrays 411 are positioned along wall 405 to facilitate cooling of assembly 404.

Figure 18:
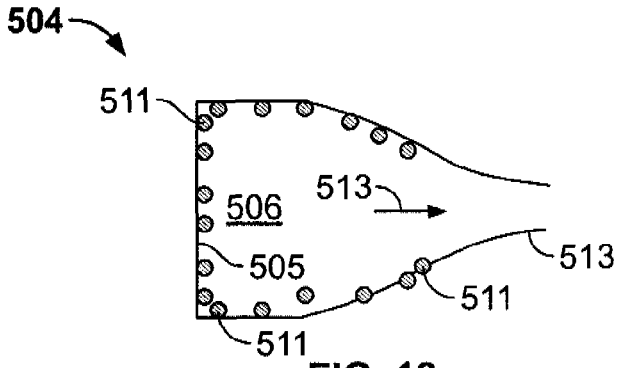
FIG. 18 is a cross-sectional schematic view of an alternative combustor assembly that may be used with the gas turbine engine shown in FIG. 1.

FIG. 18 is a cross-sectional schematic view of an alternative combustor assembly 504 that may be used with engine 100 (shown in FIG. 1). Assembly 504 includes a wall 505 that at least partially forms a combustion chamber 506. Assembly 504 also includes a plurality of LDI fuel-air arrays 511 that are substantially similar to arrays 128 (shown in FIGS. 2 and 3), 140 (shown in FIGS. 4 and 6), 145 (shown in FIGS. 5 and 6), 150 (shown in FIGS. 8, 9 and 10), 170 (shown in FIGS. 11 and 12) and/or 180 (shown in FIGS. 13 and 14). Assembly 504 is configured such that any number of arrays 511 are positioned and oriented in any configuration that facilitates forming a plurality of localized and bulk flow fields (neither shown) that further facilitate heat release rates and $NO_x$ formation rates during substantially the full range of operation of engine 100 as described herein. Assembly 504 further includes a transition piece 512 that facilitates channeling a combustion gas stream 513 towards turbine 108 (shown in FIG. 1). In this alternative embodiment, transition piece 512 may extend from combustion chamber 506 to turbine 108 with a shorter length than is often used in the art. Moreover, in this alternative embodiment, transition piece 512 and wall 505 may be manufactured as an integrated piece.

Figure 19:
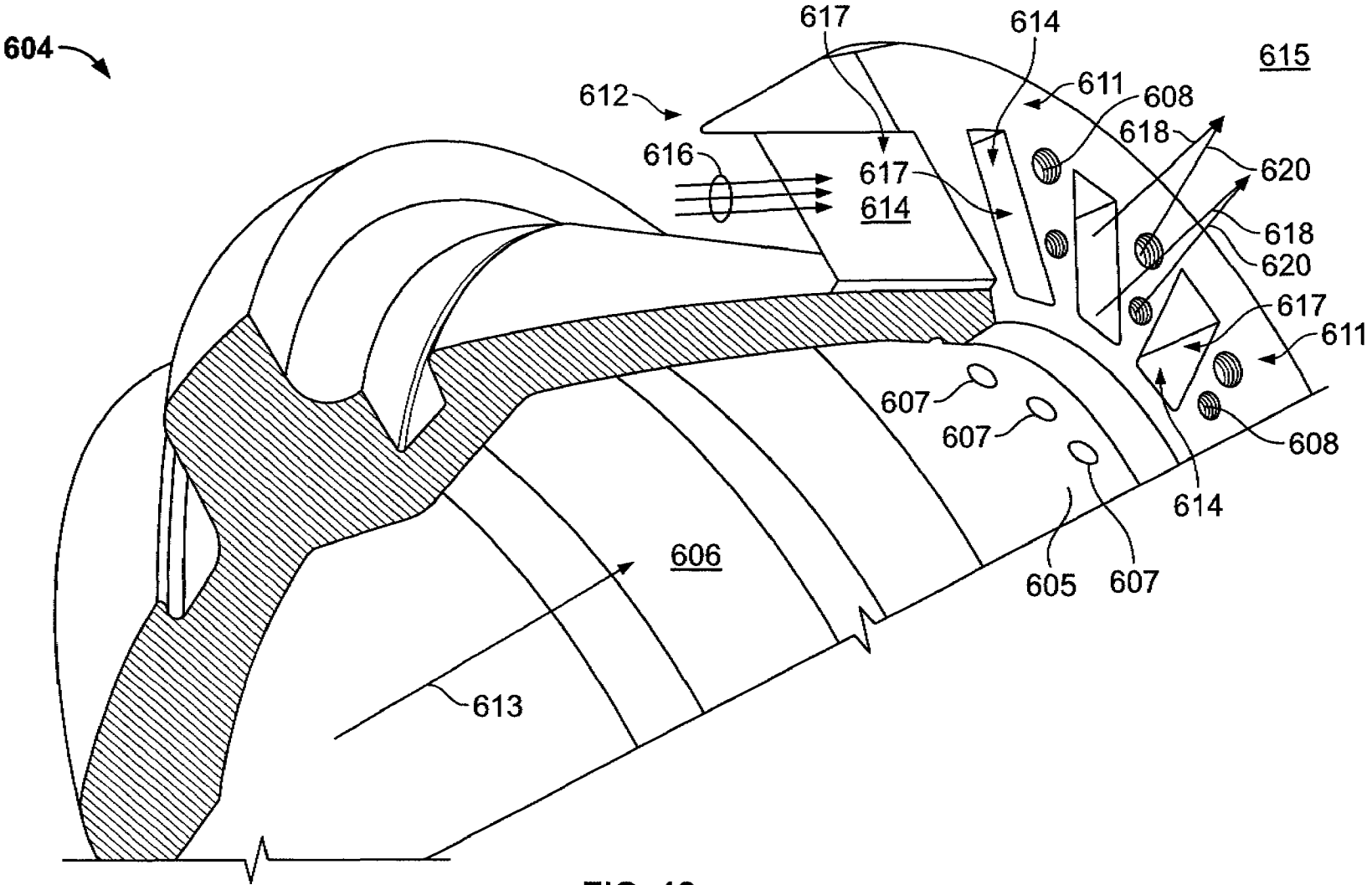
FIG. 19 is a cross-sectional schematic view of a swirler assembly that may be used with the gas turbine engine shown in FIG. 1.

FIG. 19 is a cross-sectional schematic view of a swirler assembly 604 that may be used with engine 100 (shown in FIG. 1). Assembly 604 includes a wall 605 that at least partially forms a fuel chamber 606 in which a fuel stream 613 is generated. Wall 605 includes a plurality of fuel openings 607. Assembly 604 also includes a swirl vane 612, wherein swirl vane 612 includes a plurality of substantially rectangular air chambers 614 and a plurality of fuel openings 608. Each of chambers 614 are in flow communication with at least one source of air (not shown). A plurality of fuel passages (not shown) are formed within swirl vane 612 such that openings 607 are coupled in flow communication with openings 608. Moreover, each of chambers 614 includes an opening 617. Each of air chambers 614, air openings 617, and plurality of fuel openings 618 form at least one fuel-air array 611. Array 611 is similar to arrays 128 (shown in FIGS. 2 and 3), 140 (shown in FIGS. 4 and 6), 145 (shown in FIGS. 5 and 6), 150 (shown in FIGS. 8, 9 and 10), 170 (shown in FIGS. 11 and 12) and/or 180 (shown in FIGS. 13 and 14). In one embodiment, opening 617 is substantially rectangular. Alternatively, opening 617 includes any configuration that facilitates operation of engine 100 as described herein including, but not limited to, substantially circular and elliptical openings. Moreover, in one embodiment, opening 608 is substantially circular. Alternatively, opening 608 includes any configuration that facilitates operation of engine 100 as described herein including, but not limited to, substantially rectangular and elliptical openings.

Each of air chambers 614 is configured to receive an air stream 616. Each of openings 607 and 608 are configured to receive at least a portion of fuel stream 613. Each of arrays 611 is configured to channel at least a portion of air stream 616 and fuel stream 613 into a combustion chamber 615. Array 611 channels an air stream 618 into combustion chamber 615 and channels at least one fuel stream 620 into combustion chamber 615. Fuel streams 620 are injected into combustion chamber 615 at an oblique angle with respect to air stream 618, thereby intersecting and mixing fuel stream 620 with air stream 618. Stream 618 and 620 may also include any pre-determined mixture of fuel, air, combustion gases and/or inert diluents that facilitate operation of engine 100 as described herein. Moreover, each of arrays 611 is configured to channel a pre-determined mixture as described above that differs from other arrays 611 such that pre-determined localized and bulk flow fields (neither shown) are formed within combustion chamber 615.

In operation, air stream 616 is channeled into swirler vane 612, specifically, air chambers 614. Fuel stream 613 is channeled into chamber 606 and subsequently into openings 607 formed within swirler vane 612. The fuel is channeled from openings 607 to openings 608 via associated passages. Each of arrays 611 facilitates channeling air streams 618 from chambers 614 via openings 617 into combustion chamber 615. Each of arrays 611 also facilitate channeling fuel streams 620 into combustion chamber 615 wherein each of air stream 618 and fuel stream 620 are impinged on each other to mix thoroughly within chamber 615. An air mass flow rate associated with air stream 616 and a fuel/air/diluent mass flow rate associated with stream 613 are controlled such that each chamber 615 receives a predetermined ratio of fuel, air and diluents. Pre-determined angles of impingement (not shown) between streams 618 and 620 facilitate premixing within chamber 615 such that operation of engine 100 as described herein is facilitated. Additional fuel, air and/or diluent passages may be included within swirl vane 612 to facilitate operation of engine 100 as described herein.

The gas turbine engine and combustor assembly described herein facilitates mitigating combustion product emissions while facilitating a pre-determined heat release rate per unit volume. More specifically, the engine includes a lean direct injection combustor assembly that facilitates thorough and rapid fuel and air mixing as a result of fuel and air stream impingement. Such impingement facilitates a reduction in $NO_x$, broader turn-down margins, flame stability, decreasing the size of the combustor assembly necessary to attain a particular rate of heat release, and mitigation of undesirable combustion dynamics while combusting fuels that include process gas and syngas. Subsequently, an associated air pressure drop within the cooling passages defined within a smaller combustion assembly facilitates a more efficient air injection method. As a result, the operating efficiency of such engines may be increased and the engine's capital and operational costs may be reduced.

The methods and apparatus for combusting syngas and process gas as described herein facilitates operation of a gas turbine engine. More specifically, the engine as described above facilitates a more robust combustor assembly configuration. Such combustor assembly configuration also facilitates efficiency, reliability, and reduced maintenance costs and gas turbine engine outages.

Exemplary embodiments of combustor assemblies as associated with gas turbine engines are described above in detail. The methods, apparatus and systems are not limited to the specific embodiments described herein nor to the specific illustrated gas turbine engines and combustor assemblies.

While the invention has been described in terms of various specific embodiments, those skilled in the art will recognize that the invention can be practiced with modification within the spirit and scope of the claims.

What is claimed is:

1. A method of operating a turbine engine, said method comprising:

providing at least one combustor assembly having a combustion chamber defined therein, wherein the combustion chamber has a centerline extending therethrough;

injecting at least one first fluid stream in flow communication with a first fluid source into the combustion chamber;

injecting at least one second fluid stream in flow communication with a second fluid source into the combustion chamber at an oblique angle with respect to the at least first fluid stream, thereby intersecting and mixing the at least one second fluid stream with the at least one first fluid stream;

forming a plurality of local flames within the combustion chamber, wherein the local flames are oriented to combine to form at least one bulk flame within the combustion chamber;

wherein the first fluid streams and the second fluid streams are arranged in an alternating annular relationship.

2. A method in accordance with claim 1 wherein injecting at least one second fluid stream into the combustion chamber comprises injecting the at least one second fluid stream at a first velocity and the at least one first fluid stream at a second velocity, wherein the first velocity is greater than the second velocity.

3. A method in accordance with claim 1 wherein injecting at least one second fluid stream comprises injecting the at least one second fluid stream into the chamber to induce a predetermined turbulence that facilitates rapidly mixing the at least one second fluid stream with the at least one first fluid stream, thereby attaining a predetermined combustion residence time prior to combusting at least a portion of the at least one first and second fluid streams.

4. A method in accordance with claim 1 wherein injecting at least one first fluid stream into the combustion chamber comprises at least one of:

air;

at least one combustion gas;

at least one diluent; and at least one fuel.

5. A method in accordance with claim 4 wherein injecting at least one first fluid stream into the combustion chamber further comprises at least one of:

purging fuel away from at least one combustor assembly wall to facilitate reducing flashback and flame holding within the combustor assembly; and cooling at least a portion of the at least one combustor assembly wall.

6. A method in accordance with claim 1 wherein injecting at least one second fluid stream into the combustion chamber comprises at least one of:

air;

at least one combustion gas;

at least one diluent; and at least one fuel.

7. A method in accordance with claim 6 wherein injecting at least one second fluid stream into the combustion chamber further comprises at least one of:

injecting at least one fuel stream into the combustion chamber via at least one fuel inlet defined within at least one combustor wall, wherein each of the at least one fuel inlets is positioned between a plurality of circumferentially adjacent air inlets; and injecting at least one fuel stream into the combustion chamber via a plurality of fuel inlets defined within the at least one combustor wall, wherein at least some of the plurality of fuel inlets are circumferentially positioned about at least one air inlet.

8. A method in accordance with claim 7 wherein injecting fuel into the combustion chamber via a plurality of fuel inlets comprises configuring the fuel inlets and air inlets to generate a substantially annular swirling flow pattern of a predetermined fuel-air mixture.

9. A method in accordance with claim 8 wherein configuring the fuel inlets and air inlets comprises generating a first circumferential flow pattern from a first ring of fuel inlets and air inlets and a second circumferential flow pattern from a second ring of fuel inlets and air inlets that is adjacent to the first ring, wherein a circumferential direction of the first flow pattern is at least one of:

substantially opposite a circumferential direction of the second flow pattern; and substantially the same as the circumferential direction of the second flow pattern.

10. A method in accordance with claim 7 wherein injecting at least one fuel stream into the combustion chamber comprises premixing at least two of fuel, air and a diluent upstream of at least one combustion chamber inlet to facilitate attaining a predetermined fuel-air combustion residence time.

11. A combustor assembly comprising:

at least one combustor wall defining a combustion chamber;

at least one first fluid passage defining at least one first fluid inlet within said at least one combustor wall, said at least one first fluid passage coupled in flow communication with said combustion chamber and a first fluid source, said at least one first fluid inlet configured to inject a first fluid stream into said combustion chamber; and at least one second passage defining at least one second fluid inlet within said at least one combustor wall, said at least one second fluid inlet is positioned circumferentially adjacent to said at least one first fluid inlet, said at least one second fluid inlet is coupled in flow communication with said combustion chamber and a second fluid source and is configured to inject a second fluid stream into said combustion chamber at an oblique angle with respect to said first fluid stream such that said second and first fluid streams intersect at a predetermined angle of incidence, wherein the first fluid stream and the second fluid stream are differing substances, and wherein the first fluid inlets and the second fluid inlets are arranged in an alternating annular relationship.

12. A combustor assembly in accordance with claim 11 wherein said at least one second fluid inlet comprises a plurality of second fluid inlets circumferentially adjacent to a plurality of first fluid inlets, said plurality of second fluid inlets and said plurality of first fluid inlets configured in at least one substantially circular ring, wherein said plurality of second fluid inlets and said first fluid inlets are configured to cooperate to form at least one substantially circular fluid flow pattern.

13. A combustor assembly in accordance with claim 12 wherein said at least one substantially circular ring comprises a plurality of substantially concentric and annular rings configured to form a first substantially concentric and annular flow pattern having a first substantially circumferential direction and at least one adjacent substantially concentric and annular flow pattern having a second substantially circumferential direction, said first and adjacent substantially concentric and annular flow patterns comprise at least one of:

said first substantially circumferential direction is substantially opposed to said second substantially circumferential direction; and said first substantially circumferential direction is substantially similar to said second substantially circumferential direction.

14. A combustor assembly in accordance with claim 11 further comprising at least one swirler assembly wherein said at least one swirler assembly is positioned within said combustor assembly, said at least one swirler assembly configured to mix the first fluid and the second fluid prior to injection into said combustion chamber, said at least one swirler assembly comprising:

at least one chamber coupled in flow communication with the second fluid source;

at least one swirl vane coupled in flow communication with said at least one chamber and the first fluid source; and the plurality of second fluid inlets configured to facilitate injecting said second fluid stream into said combustion chamber at an oblique angle with respect to said first fluid stream such that said second and first streams intersect at a predetermined angle of incidence.

15. A combustor assembly in accordance with claim 14 wherein said plurality of fluid inlets are configured to be at least one of:

a substantially rectangular slot;

a substantially elliptical slot; and a substantially circular slot.

16. A combustor assembly in accordance with claim 11 wherein said at least one first fluid stream comprises at least one of:

air;

at least one combustion gas;

at least one diluent; and at least one fuel.

17. A combustor assembly in accordance with claim 11 wherein said at least one second fluid stream comprises at least one of:

air;

at least one combustion gas;

at least one diluent; and at least one fuel.

18. A combustor assembly in accordance with claim 11 further comprising at least one fluid array wherein said at least one fluid array is defined within at least a portion of said at least one combustor wall, said at least one fluid array comprises at least one of:

a plurality of second fluid inlets spaced circumferentially about said at least one first fluid inlet; and a plurality of first fluid inlets spaced circumferentially about said at least one second fluid inlet.

19. A combustor assembly in accordance with claim 18 wherein said at least one fluid array comprises a plurality of substantially annular and concentric rings defined within at least a portion of said at least one combustor wall.

20. A combustor assembly in accordance with claim 18 wherein each of said plurality of second fluid inlets is positioned between a pair of circumferentially adjacent first fluid inlets.

21. A combustor assembly in accordance with claim 11 wherein said at least one second fluid inlet is configured to inject second fluid into said combustion chamber with at least one of the following:

a radial angle of incidence within a range between approximately 0° to 90° wherein said first fluid stream is injected into said combustion chamber in a plane substantially parallel to a combustion chamber centerline extending through said combustion chamber; and a circumferential angle of incidence within a range between approximately 0° to 90° wherein said first fluid stream is injected into said combustion chamber in a plane substantially parallel to the combustion chamber centerline.

22. A combustor assembly in accordance with claim 11 wherein said at least one second fluid inlet is configured to inject said second fluid stream into said combustion chamber with at least one of the following:

a radial angle of incidence within a range between approximately 0° to 90° wherein said first fluid stream injected into said combustion chamber is with an angle oblique to a combustion chamber centerline extending through said combustion chamber; and a circumferential angle of incidence within a range between approximately 0° to 90° wherein said first fluid stream is injected into said combustion chamber with an angle that is oblique to the combustion chamber centerline.

23. A turbine engine, said engine comprising:

at least one first fluid source;

at least one second fluid source; and a combustor assembly coupled in flow communication with said at least one first fluid source and said at least one second fluid source, said combustor assembly comprising at least one combustor wall, at least one first fluid passage, and at least one second fluid passage, said at least one combustor wall defining a combustion chamber, said at least one first fluid passage defining at least one first fluid inlet within said at least one combustor wall, said at least one first fluid passage coupled in flow communication with said combustion chamber and said first fluid source, said at least one first fluid inlet configured to inject a first fluid stream into said combustion chamber, said at least one second fluid passage defining at least one second fluid inlet within said at least one combustor wall, said at least one second fluid inlet is positioned circumferentially adjacent to said at least one first fluid inlet, said at least one second fluid inlet is coupled in flow communication with said combustion chamber and said second fluid source and is configured to inject a second fluid stream into said combustion chamber at an oblique angle with respect to said first fluid stream such that said second fluid and first fluid streams intersect at a predetermined angle of incidence, wherein the first fluid stream and the second fluid stream are differing substances; and wherein the first fluid inlets and the second fluid inlets are arranged in an alternating annular relationship.

24. A turbine engine in accordance with claim 23 wherein said at least one first fluid source is a compressor.

25. A turbine engine in accordance with claim 23 wherein said at least one second fluid inlet comprises a plurality of second fluid inlets circumferentially adjacent to a plurality of first fluid inlets, said plurality of second fluid inlets and said plurality of first fluid inlets configured in at least one substantially circular ring, wherein said plurality of second fluid inlets and said first fluid inlets are configured to cooperate to form at least one substantially circular fluid flow pattern.

26. A turbine engine in accordance with claim 25 wherein said at least one substantially circular ring comprises a plurality of substantially concentric and annular rings configured to form a first substantially concentric and annular flow pattern having a first substantially circumferential direction and at least one adjacent substantially concentric and annular flow pattern having a second substantially circumferential direction, said first and adjacent substantially concentric and annular flow patterns comprise at least one of:

said first substantially circumferential direction is substantially opposed to said second substantially circumferential direction; and said first substantially circumferential direction is substantially similar to said second substantially circumferential direction.

27. A turbine engine in accordance with claim 24 further comprising at least one swirler assembly wherein said at least one swirler assembly is positioned within said combustor assembly, said at least one swirler assembly configured to mix the first fluid and the second fluid prior to injection into said combustion chamber, said at least one swirler assembly comprising:

at least one chamber coupled in flow communication with the second fluid source;

at least one swirl vane coupled in flow communication with said at least one chamber and the first fluid source; and a plurality of fluid inlets configured to facilitate injecting said second fluid stream into said combustion chamber at an oblique angle with respect to said first fluid stream such that said second and first streams intersect at a predetermined angle of incidence.

28. A turbine engine in accordance with claim 22 wherein said plurality of fluid inlets are configured to be at least one of:

a substantially rectangular slot;

a substantially elliptical slot; and a substantially circular slot.

29. A turbine engine in accordance with claim 23 wherein said at least one first fluid stream comprises at least one of:

air;

at least one combustion gas;

at least one diluent; and at least one fuel.

30. A turbine engine in accordance with claim 23 wherein said at least one second fluid stream comprises at least one of:

air;

at least one combustion gas;

at least one diluent; and at least one fuel.

31. A turbine engine in accordance with claim 23 further comprising at least one fluid array wherein said at least one fluid array is defined within at least a portion of said at least one combustor wall, said at least one fluid array comprises at least one of:

a plurality of second fluid inlets spaced circumferentially about said at least one first fluid inlet; and a plurality of first fluid inlets spaced circumferentially about said at least one second fluid inlet.

32. A turbine engine in accordance with claim 31 wherein said at least one fluid array comprises a plurality of substantially annular and concentric rings defined within at least a portion of said at least one combustor wall.

33. A turbine engine in accordance with claim 31 wherein each of said plurality of second fluid inlets is positioned between a pair of circumferentially adjacent first fluid inlets.

34. A turbine engine in accordance with claim 23 wherein said at least one second fluid inlet is configured to inject second fluid into said combustion chamber with at least one of the following:

a radial angle of incidence within a range between approximately 0° to 90° wherein said first fluid stream is injected into said combustion chamber in a plane substantially parallel to a combustion chamber centerline extending through said combustion chamber; and a circumferential angle of incidence within a range between approximately 0° to 90° wherein said first fluid stream is injected into said combustion chamber in a plane substantially parallel to the combustion chamber centerline.

35. A turbine engine in accordance with claim 23 wherein said at least one second fluid inlet is configured to inject said second fluid stream into said combustion chamber with at least one of the following:

a radial angle of incidence within a range between approximately 0° to 90° wherein said first fluid stream injected into said combustion chamber is with an angle oblique to a combustion chamber centerline extending through said combustion chamber; and a circumferential angle of incidence within a range between approximately 0° to 90° wherein said first fluid stream is injected into said combustion chamber with an angle that is oblique to the combustion chamber centerline.

* * * * *